US010540885B2

(12) United States Patent
Liang et al.

(10) Patent No.: US 10,540,885 B2
(45) Date of Patent: Jan. 21, 2020

(54) FIRE ALARM SYSTEMS

(71) Applicant: Siemens Schweiz AG, Zurich (CH)

(72) Inventors: Hong Xiang Liang, Beijing (CN); Xue Song Shen, Beijing (CN); Jian Tan, Beijing (CN)

(73) Assignee: SIEMENS SCHWEIZ AG, Zurich (CH)

( * ) Notice: Subject to any disclaimer, the term of this patent is extended or adjusted under 35 U.S.C. 154(b) by 250 days.

(21) Appl. No.: 15/606,416

(22) Filed: May 26, 2017

(65) Prior Publication Data

US 2017/0345286 A1 Nov. 30, 2017

(30) Foreign Application Priority Data

May 31, 2016 (CN) ..... 2016 1 0375382

(51) Int. Cl.
*G08B 29/10* (2006.01)
*G08B 5/38* (2006.01)
(Continued)

(52) U.S. Cl.
CPC ..... *G08B 29/10* (2013.01); *G08B 5/38* (2013.01); *H05B 33/089* (2013.01); *H05B 33/0842* (2013.01); *G08B 17/00* (2013.01)

(58) Field of Classification Search
CPC ..... G08B 29/10; G08B 5/38; H05B 33/089; H05B 33/0842
See application file for complete search history.

(56) References Cited

U.S. PATENT DOCUMENTS

2007/0035255 A1 2/2007 Shuster et al. ..... 315/200 R
2010/0049454 A1* 2/2010 Irissou ..... H05B 33/0893 702/58
(Continued)

FOREIGN PATENT DOCUMENTS

CN 202454008 U 9/2012 ..... G08B 29/00
CN 103778755 A 5/2014 ..... G08B 25/04
(Continued)

OTHER PUBLICATIONS

European Office Action, Application No. 17173543.4, 5 pages, dated Jul. 10, 2018.
(Continued)

*Primary Examiner* — Douglas W Owens
*Assistant Examiner* — Pedro C Fernandez
(74) *Attorney, Agent, or Firm* — Slayden Grubert Beard PLLC

(57) ABSTRACT

The present disclosure generally relates to the field of fire alarms. The teachings thereof may be embodied in a strobe notification appliance having: a boost circuit connected to an input voltage; an energy storage circuit charged by the boost circuit; a drive circuit generating a drive current; an LED circuit with at least one LED element; a first sampling circuit collecting an overall voltage drop of all the LED elements; and a control circuit configured to adjust the drive circuit to supply a working current during an alarming stage and supply a detection current during a detection stage. The detection current is lower than the working current and thereby light energy produced by the LED elements during the detection stage is lower than alarming light energy produced during the alarming stage. During the detection stage, the control circuit determines whether the LED circuit works normally based on the collected overall voltage drop.

18 Claims, 6 Drawing Sheets

(51) Int. Cl.
*H05B 33/08* (2006.01)
*G08B 17/00* (2006.01)

(56) References Cited

U.S. PATENT DOCUMENTS

| | | | | |
|---|---|---|---|---|
| 2010/0225235 | A1* | 9/2010 | Nagase | H05B 33/0815 315/130 |
| 2011/0175543 | A1* | 7/2011 | Sun | H05B 33/0818 315/291 |
| 2012/0187863 | A1* | 7/2012 | Nonaka | H05B 33/0815 315/291 |
| 2014/0097849 | A1* | 4/2014 | Brancken | H05B 33/089 324/414 |
| 2014/0333450 | A1* | 11/2014 | Savage, Jr. | G08B 5/38 340/815.45 |

FOREIGN PATENT DOCUMENTS

| | | | | |
|---|---|---|---|---|
| CN | 204836752 | U | 12/2015 | H05B 37/03 |
| DE | 9213146 | U1 | 3/1993 | B61L 1/20 |
| EP | 1338899 | A1 | 8/2003 | F21S 2/00 |
| EP | 2701132 | A1 | 2/2014 | G08B 25/04 |
| JP | 2016126545 | A | 7/1916 | G08B 17/00 |

OTHER PUBLICATIONS

Chinese Office Action, Application No. 201610375382.5, 10 pages, dated Aug. 2, 2018.
European Extended Search Report, Application No. 17173543.4, 9 pages, dated Sep. 25, 2017.

* cited by examiner

FIRE ALARM SYSTEMS

CROSS-REFERENCE TO RELATED APPLICATIONS

This application claims priority to CN Application No. 201610375382.5 filed May 31, 2016, the contents of which are hereby incorporated by reference in their entirety.

TECHNICAL FIELD

The present disclosure generally relates to the field of fire alarms. The teachings thereof may be embodied in a notification appliance in a fire fighting system.

BACKGROUND

FIG. 1 shows a schematic diagram of a typical fire alarming system. As shown in FIG. 1, in a fire alarming system, a control panel 160 is connected to a plurality of notification appliances 190 distributed in a building. These notification appliances may be connected to one line network in parallel, and the network is connected to the control panel 160. The notification appliances may obtain electric energy from the fire alarming control panel 160 via the line network and communicate with the fire alarming control panel 160. The notification appliance 190 in FIG. 1, for example, may be a sound alarm and may also be a strobe alarming device, or referred to as a "strobe notification appliance", while the latter one, for example, uses a xenon lamp or a light-emitting diode (LED), etc. as a light-emitting element.

In recent years, more and more manufacturers use the LED as a light-emitting element of a strobe notification appliance. When there is fire or an emergency, the strobe notification appliance drives the LED to emit strobe light so as to alert people to evacuate in time. Using a high-power LED as the light-emitting element may reduce the electric energy consumption of the strobe notification appliance and simplify the complexity of a drive circuit, and thus it gradually forms a development trend in the field of fire fighting.

FIG. 2 exemplarily shows a typical circuit of a strobe notification appliance. As shown in FIG. 2, a strobe notification appliance 200 comprises a boost circuit 210, an energy storage circuit 220, a drive circuit 230, an LED circuit 240 constituted by a plurality of LED elements connected in series, and a control circuit 250. The boost circuit 210 is connected to an electric energy input end of the strobe notification appliance 200, that is, connected to the line network in FIG. 1. The energy storage circuit 220 may be a large capacitor C1, which is charged by the boost circuit 210. The drive circuit 230 is powered by the energy storage circuit 220, so as to supply a drive current I_work for the plurality of LED elements connected together in series. The LED elements are illuminated under the effect of the drive current. The control circuit 250 controls the frequency and intensity of LED element flashing by sending a control signal Ctrl to the drive circuit 230. The control circuit 250 may be a micro-controller (MCU), and may also be a circuit composed of discrete elements.

SUMMARY

The teachings of the present disclosure may be embodied in a strobe notification appliance comprising: a boost circuit (210) connected to an input voltage of the strobe notification appliance to supply electric energy; an energy storage circuit (220) charged by the boost circuit (210); a drive circuit (230) powered by the energy storage circuit (220) and outputting a drive current; an LED circuit (240) comprising at least one LED element connected in series, wherein drive current for the LED elements is supplied by the drive circuit (230); a first sampling circuit (460) collecting an overall voltage drop (V_LED) of all the LED elements in the LED circuit (240); and a control circuit (450, 550, 650) connected to the drive circuit (230) and configured to cause the drive circuit (230) to supply a working current (I_work) for the LED circuit (240) at an alarming stage and supply a detection current (I_detect) for the LED circuit (240) at a detection stage, wherein the detection current (I_detect) is lower than the working current (I_work) and can cause light energy produced by the LED elements in the LED circuit (240) at the detection stage to be far lower than alarming light energy produced at the alarming stage or even cause the LED elements not to emit light at the detection stage. In addition, the control circuit (450, 550, 650) may be configured to determine at the detection stage, according to the collected overall voltage drop (V_LED), whether the LED circuit (240) works normally.

In some embodiments, the detection current (I_detect) is configured to be at a level from 100 pA to tens of mA, or the ratio of an effective value of the working current (I_work) to an effective value of the detection current (I_detect) is greater than 60 times, or the ratio of the effective value of the working current (I_work) to the effective value of the detection current (I_detect) is greater than 100 times.

In some embodiments, the detection current (I_detect) is a constant current or the detection current (I_detect) is in a pulse form, or the detection current (I_detect) is in a pulse shape of which the duty cycle changes periodically.

In some embodiments, the control circuit (450, 550, 650) is configured to make the determination according to the following criterion: if the overall voltage drop (V_LED) is substantially equal to the sum of threshold voltages (Vd) of the at least one LED element, it is indicated that the LED circuit works normally.

In some embodiments, the control circuit (450, 550, 650) is configured to make the determination according to the following criterion: if the overall voltage drop (V_LED) is greater than the sum of threshold voltages (Vd) of all the LED elements in the LED circuit (240), it is indicated that an open-circuit fault occurs in at least one of the LED elements.

In some embodiments, the control circuit (450, 550, 650) is configured to make the determination according to the following criterion: if the overall voltage drop (V_LED) is less than the sum of threshold voltages (Vd) of all the LED elements in the LED circuit (240), it is indicated that a short-circuit fault occurs in at least one of the LED elements.

In some embodiments, there is a second sampling circuit (562) collecting a first voltage (V_led) at a positive end of a first LED element in the LED circuit, a negative end of the first LED element being connected to the ground; and the control circuit (550, 650) is configured to make the determination according to the following criterion: if the overall voltage drop (V_LED) is substantially equal to the sum of threshold voltages (Vd) of all the LED elements and the first voltage (V_led) is substantially equal to a positive threshold voltage (Vd) of the first LED element, it is indicated that the LED circuit (240) works normally.

In some embodiments, the control circuit (450, 550, 650) is configured to determine that at least one LED element in the LED circuit is short-circuited if the overall voltage drop (V_LED) meets the following condition:

$$V_LED<(N-1)*Vd+\alpha*Vd,$$

where

V_LED is the overall voltage;

Vd is the threshold voltage of each LED element;

N is the number of the LED elements in the LED circuit (240);

$\alpha$ is an empirical value, $0<\alpha<1$, preferably, $\alpha$ is substantially equal to 50%.

In some embodiments, the drive circuit (530) comprises: a working current generation circuit (535) supplying the working current (I_work) for the LED circuit (240), to emit alarming light; a detection current generation circuit (537) supplying the detection current (I_detect) for the LED circuit (240); and a toggle switch (531) selectively transferring the electric energy from the energy storage circuit (220) to one of the working current generation circuit (535) and the detection current generation circuit (537). In some embodiments, the control circuit (550) is connected to the toggle switch (531), and the toggle switch (531) switches in response to the control of the control circuit (550).

In some embodiments, the drive circuit (630) comprises a current regulating end (632) connected to the control circuit (650) and selectively supplying one of the working current (I_work) and the detection current (I_detect) for the LED circuit (240) in response to a first instruction (Ctrl_CurB) of the control circuit (650).

In some embodiments, the drive circuit (630) further comprises an enable end (634) connected to the control circuit (650) and selectively turning on or turning off the current output of the drive circuit in response to a second instruction (PWM) of the control circuit (650), wherein the second instruction is a pulse width modulation (PWM) signal, and preferably, the duty cycle of the PWM signal is fixed or the duty cycle changes periodically.

In some embodiments, there is a third sampling circuit (580) collecting energy storage voltages (Vcap) on two ends of an energy storage element (C1) in the energy storage circuit (220), and the control circuit (450, 550, 650) determines an actual eigenvalue of the energy storage element (C1) according to the energy storage voltages (Vcap) sampled by the third sampling circuit (580) and a sampling time interval (t), or the energy storage element (C1) is a capacitor and the actual eigenvalue is an actual capacitance.

In some embodiments, there is a discharging circuit (570) connected to two ends of the energy storage circuit (220) in parallel, the discharging circuit (570) comprising a current-limiting circuit (574) and a controlled switch (572) connected in series to the current-limiting circuit. In some embodiments, the control circuit (550) controls the controlled switch (570) to switch on at the detection stage, to cause the energy stored in the energy storage circuit (220) to be discharged via the current-limiting circuit (574).

In some embodiments, the current-limiting circuit (574) is a current-limiting resistor (r), and the control circuit (550) is configured to calculate the actual capacitance of the capacitor according to the following formula:

$$C=\frac{t}{r\cdot\ln\left(\frac{V_0}{V_t}\right)}$$

where t denotes discharging time;

r denotes the resistance of the current-limiting resistor;

$V_0$ denotes an initial voltage of the capacitor prior to discharging; and $V_t$ denotes the residual voltage of the capacitor after the discharging time t.

In some embodiments, the control circuit (550) is configured to calculate the actual capacitance of the capacitor according to the following formula:

$$C=\frac{I*t}{\Delta U_t}$$

where $\Delta U_t$ is the difference between the voltages (Vcap) on the capacitor before and after the current detection stage, I is an equivalent current value when the capacitor is discharged, and t is the discharging time of the capacitor.

In some embodiments, the control circuit (550, 560) is configured to calculate the actual capacitance of the capacitor according to the following formula:

$$C=C_0*\frac{\Delta U_0}{\Delta U_t}$$

where $C_0$ is the capacitance of the capacitor (C1) when leaving the factory;

$\Delta U_0$ is the difference between the voltages (Vcap) on the capacitor before and after the first detection stage; and $\Delta U_t$ is the difference between the voltages (Vcap) on the capacitor before and after the current detection stage.

BRIEF DESCRIPTION OF THE DRAWINGS

The attached drawings merely illustratively describe and explain the present teachings and do not limit the scope of the present invention.

The word "illustrative" represents "acting as an instance, example or description" herein, and any graphical representation and implementation method described as "illustrative" herein should not be construed as a more preferable or more advantageous technical solution. To make the figures concise, the parts relevant to the present teachings are merely shown illustratively in the figures, and they do not represent the actual structure as a product. In addition, to make the figures concise and easy to be understood, in some figures, there are components of the same structure or function, and only one therein is drawn illustratively or only one therein is marked.

DETAILED DESCRIPTION

Figure 1:
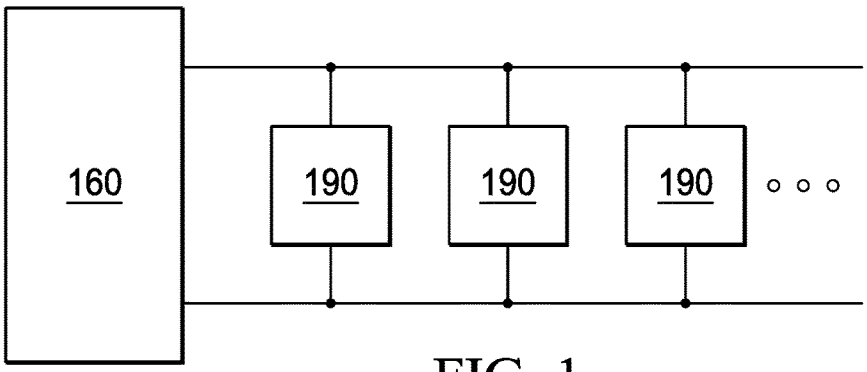
FIG. 1 (PRIOR ART)
FIG. 1 shows a prior art fire alarming system.
Figure 2:
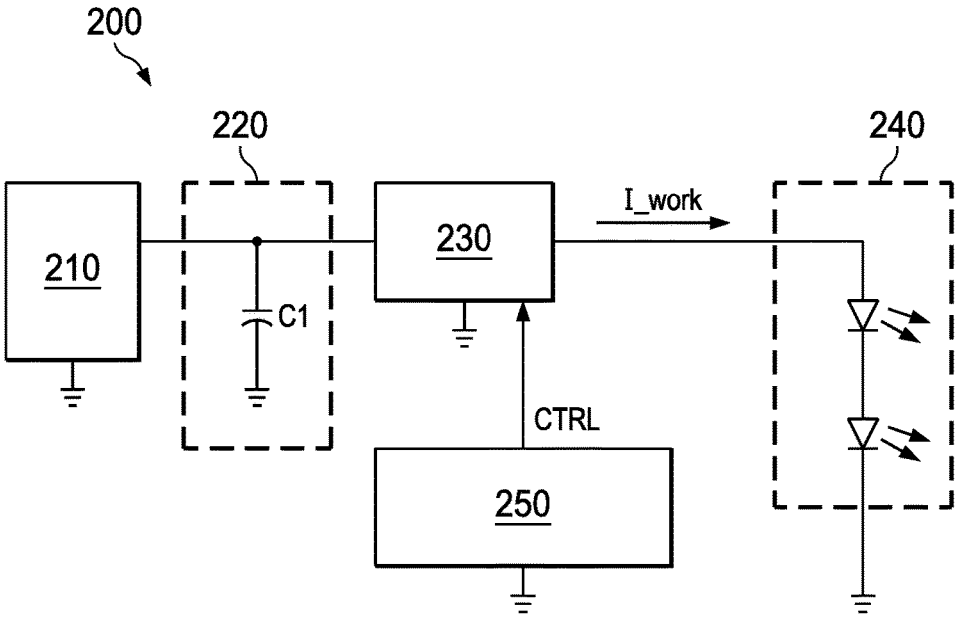
FIG. 2 (PRIOR ART)
FIG. 2 shows a prior art strobe notification appliance circuit, wherein LED elements are light-emitting elements.

The LED elements and the large capacitor C1 in FIG. 2 are key components of the strobe notification appliance. In the running process of the strobe notification appliance, the LED may have a short-circuit or open-circuit fault, and at the same time, the large capacitor C1 may also degenerate with the lengthening of use time. Therefore, there is a need to periodically detect the working conditions of the LED elements and the large capacitor in the strobe notification appliance, so as to find a fault in time. However, in practical use, since the LED used in the strobe notification appliance is a high-power LED and the flashing intensity is so high that it cannot be directly observed by naked eyes, this brings about difficulties to detection.

The teachings of the present disclosure may be embodied in a strobe notification appliance in a fire fighting system, which strobe notification appliance can detect whether LED elements work normally. Some embodiments may include a strobe notification appliance in a fire fighting system, which strobe notification appliance can detect whether an energy storage element works normally or whether the energy storage element degenerates.

In some embodiments, a strobe notification appliance comprises: a boost circuit connected to an input voltage of the strobe notification appliance to supply electric energy; an energy storage circuit charged by the boost circuit; a drive circuit powered by the energy storage circuit and outputting a drive current; an LED circuit comprising at least one LED element connected in series, wherein drive current for the LED elements is supplied by the drive circuit; a first sampling circuit collecting the overall voltage drop of all the LED elements in the LED circuit; and a control circuit controlling the drive circuit, so that the drive circuit supplies a working current for the LED circuit at an alarming stage and supplies a detection current for the LED circuit at a detection stage, wherein the detection current is lower than the working current and can cause light energy produced by the LED elements in the LED circuit at the detection stage to be far lower than alarming light energy produced at the alarming stage or even cause the LED elements not to emit light at the detection stage. In some embodiments, the control circuit determines at the detection stage, according to the collected overall voltage drop, whether the LED circuit works normally.

In some embodiments, the detection current is configured to be at a level from 100 pA to tens of mA, or, the ratio of an effective value of the working current to an effective value of the detection current is greater than 60 times, and/or the ratio of the effective value of the working current to the effective value of the detection current is greater than 100 times.

The strobe notification appliance described above achieves fault detection of the LED elements by applying a small current as the detection current to the LED elements connected in series. Such a strobe notification appliance does not only have a self-detection function, but will also not enable the LED to emit light with an excessively high intensity at the detection stage which draws the attention from field staff, and may even not result in eye damage of the field staff due to strong light.

In some embodiments, the detection current is a constant current or the detection current is in a pulse form, e.g., the detection current is in a pulse shape of which the duty cycle changes periodically. Taking a pulse signal as the detection current, even if the amplitude value of a single detection current pulse approaches to or is equal to the working current, since the pulse width thereof can be controlled as very small, for example, a magnitude of a few milliseconds, the overall illumination formed thereby may also not damage human eyes.

In addition, using such a pulse detection current to drive the LED elements may further reduce the electric energy consumption at the detection stage, and is less likely to draw excessive attention from field staff. Moreover, using a signal with a periodically changing pulse width as the detection current may supply breath-type detection light, and in this way, the light emitted by the LED elements is softer and supplies a comfortable feeling for the field staff, and may even not damage naked eyes. At the same time, since a pulse width regulation method is used, the electric energy consumption at the detection stage may further be decreased.

In some embodiments, the control circuit is configured to make the determination according to the following criterion: if the overall voltage drop is substantially equal to the sum of threshold voltages of the at least one LED element, it is indicated that the LED circuit works normally.

In some embodiments, the control circuit is further configured to make the determination according to the following criterion: if the overall voltage drop is greater than the sum of threshold voltages of the at least one LED element, it is indicated that an open-circuit fault occurs in at least one of the at least one LED elements.

In some embodiments, the control circuit is configured to make the determination according to the following criterion: if the overall voltage drop is less than the sum of threshold voltages of the at least one LED element, it is indicated that a short-circuit fault occurs in at least one of the at least one LED elements.

Applying the criteria above can conveniently determine whether there is a fault element in the LED elements according to the overall voltage drop of the LED elements sampled in a small detection current.

In some embodiments, the strobe notification appliance further comprises: a second sampling circuit collecting a first voltage at a positive end of a first LED element in the LED circuit, a negative end of the first LED element being connected to the ground; moreover, the control circuit is configured to make the determination according to the following criterion: if the overall voltage drop is substantially equal to the sum of threshold voltages of all the LED elements and the first voltage is substantially equal to a positive threshold voltage of the first LED element, it is indicated that all the LED elements in the LED circuit work normally.

In some embodiments, the control circuit is further configured to determine that at least one LED element in the LED circuit is short-circuited if the overall voltage drop meets the following condition:

$$V_LED<(N-1)*Vd+\alpha*Vd,$$

where V_LED is the overall voltage;

Vd is the threshold voltage of each LED element;

N is the number of the LED elements in the LED circuit (240);

$\alpha$ is an empirical value, $0<\alpha<1$, and preferably, a is substantially equal to 50%.

Applying a method of mutual cooperation of the sampling value of the second sampling circuit and the sampling value of the first sampling circuit for fault determination can increase the accuracy of fault determination and avoid false alarm. In addition, in certain cases, the fault position of one LED element can be at least determined.

In some embodiments, the drive circuit in the strobe notification appliance comprises: a working current generation circuit supplying the working current for the LED circuit, to emit alarming light; a detection current generation circuit supplying the detection current for the LED circuit;

and a toggle switch selectively transferring the electric energy from the energy storage circuit to one of the working current generation circuit and the detection current generation circuit. In some embodiments, the control circuit is connected to the toggle switch, and the toggle switch switches in response to the control of the control circuit.

Two discrete current branches are used to respectively generate the working current and the detection current, and which current branch is to work is chosen by utilizing a controlled toggle switch. Such a circuit is simple in structure and avoids the interference on the working current from the detection current, has stable performance and is easy to control.

In some embodiments, the drive circuit comprises: a current regulating end connected to the control circuit and selectively supplying one of the working current and the detection current for the LED circuit in response to a first instruction of the control circuit. A drive circuit is used to generate the working current and the detection current, and a current regulating end is utilized to change the amplitude value of the current. Such a circuit structure is easy to adjust the current amplitude value according to requirements, and is more flexible in manipulation.

In some embodiments, the drive circuit comprises: an enable end connected to the control circuit and selectively turning on or turning off the current output of the drive circuit in response to a second instruction of the control circuit, wherein the second instruction is a pulse width modulation signal, and preferably, the duty cycle of the pulse width modulation signal is fixed or the duty cycle changes periodically. Implementing the pulse detection current by controlling the enable end of the drive circuit simplifies control of the pulse period and duty cycle of the detection current.

In some embodiments, the strobe notification appliance further comprises: a third sampling circuit collecting energy storage voltages on two ends of an energy storage element in the energy storage circuit, and the control circuit being further configured to determine an actual eigenvalue of the energy storage element according to the energy storage voltages sampled by the third sampling circuit and a sampling time interval, and/or the energy storage element is a capacitor, and the actual eigenvalue is an actual capacitance.

Applying the strobe notification appliance above only detects whether there is a fault in the LED elements, but can monitor whether the energy storage element in the strobe notification appliance degenerates at the same time. In addition, the performance of the energy storage element may be measured by utilizing the characteristic of constant energy consumption at the detection stage.

In some embodiments, the strobe notification appliance further comprises: a discharging circuit connected to two ends of the energy storage circuit in parallel, the discharging circuit comprising a current-limiting circuit and a controlled switch connected in series to the current-limiting circuit, wherein the control circuit controls the controlled switch to switch on at the detection stage, to cause the energy stored in the energy storage circuit to be discharged via the current-limiting circuit. Here the discharging circuit where the energy storage element is added to the strobe notification appliance may accelerate the discharging process of the energy storage element, and the performance of the energy storage element is detected in the discharging process. In this way, the detection for the energy storage element is more convenient.

The above characteristics, technical features, advantages and implementation methods of the switching apparatus will be further described below in a manner which is clear and easy to be understood and in conjunction with example embodiments in the accompanying drawings.

Figure 3:
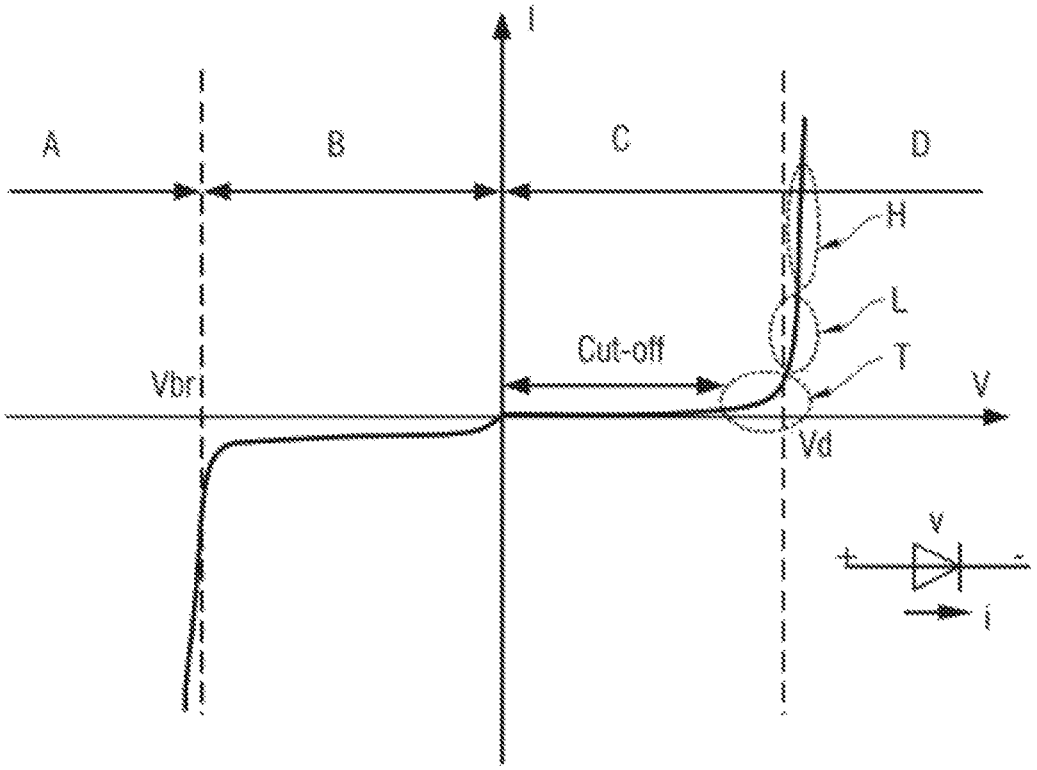
FIG. 3 shows voltage current characteristics of an LED element according to teachings of the present disclosure.

FIG. 3 shows an example voltage current characteristic curve of an LED element. The voltage between the two ends of the LED element is represented as v, and the current flowing through the LED is represented as i. The voltage current characteristic curve as shown in FIG. 3 may substantially be divided into four regions A-D. The region A is a reverse breakdown zone of the LED (v reverse breakdown voltage Vbr<0). The region B is a reverse bias zone (Vbr<v<0). The region C is a forward bias zone (0<v<threshold voltage Vd), comprising a cut-off zone Cut-off and a transition zone T. The region D is a linear zone of the LED (v>Vd).

In the linear zone D, the voltage v between the two ends of the LED is greater than a threshold voltage drop Vd. At this moment, with the increase of the current i flowing through the LED, the light-emitting intensity of the LED increases. For example, in a segment L, the voltage V is greater than Vd, and the LED is illuminated. However, since the current value is relatively low, the LED light-emitting intensity is relatively weak accordingly and naked eyes can look at same directly, and the voltage v between the two ends of the LED is only slightly greater than the threshold voltage Vd thereof. In a segment H, the current i is relatively high, and the LED light-emitting intensity may meet a high-intensity flashing requirement of the strobe notification appliance accordingly. The segment H here can be referred to as a normal working zone of the strobe notification appliance.

In addition, as shown in FIG. 3, in a transition segment T (located between the cut-off zone and the linear zone) of the region C, the voltage v between the two ends of the LED approaches to Vd but is less than Vd, and the LED at this time is in a transition state and the LED does not emit light, but the current value i flowing through the LED is greater than 0.

With reference to FIG. 3, it is noted that if an appropriate small current is used to drive the LED, then the LED may work in a non-normal working region of the strobe notification appliance, such as the segment L with a low light intensity or the segment T where light is not emitted. That is to say, a small current makes the LED not emit light or emit weak light, but maintains that there is a current flowing through the LED, so that the detection for a strobe notification appliance fault can be achieved, while no excessive attention from field staff may be drawn.

Figure 4:
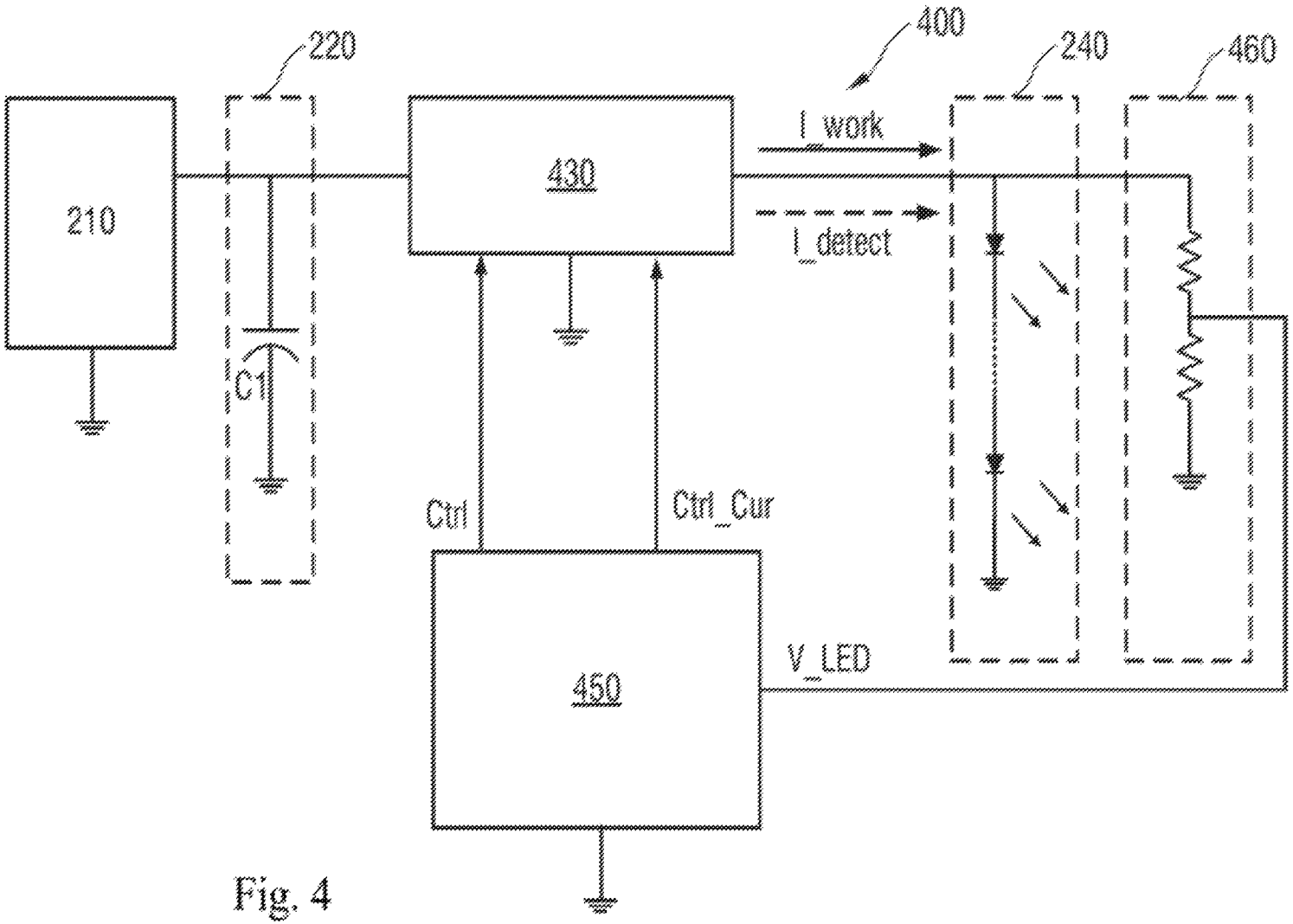
FIG. 4 shows a circuit of a strobe notification appliance according to teachings of the present disclosure.

FIG. 4 shows an example strobe notification appliance having a detection function according to teachings of the present disclosure. Similar to FIG. 2, the strobe notification appliance 400 in FIG. 4 comprises a boost circuit 210, an energy storage circuit 220, and an LED circuit 240 comprising a plurality of LED elements connected in series. The elements have the same or similar function as or to those in FIG. 2, and this will not be described again herein.

The drive circuit 430 in the strobe notification appliance 400 can selectively supply one of the working current I_work and the detection current I_detect for the LED circuit 240, wherein the effective value (root-mean-square) of the detection current I_detect is far less than the working current I_work. For example, the detection current is, e.g. at a 100 pA magnitude or dozens mA magnitude. In particular, the ratio of the effective value of the detection current to the effective value of the working current may be greater than 60 times, e.g., greater than 100 times. The strobe notification appliance 400 further comprises a first sampling circuit 460 which collects the overall voltage drop V_LED between the two ends of the LED circuit and passes same to an MCU 450. In addition to a conventional control signal Ctrl, the MCU 450 further connects with the drive circuit 430 via a control signal Ctrl_Cur so as to achieve current switching.

In the example shown in FIG. 4, the strobe notification appliance 400 may work in two modes, e.g. an alarming mode and a detection mode. Generally, the detection mode may happen before alarming or at intervals of alarming. In the alarming mode, the MCU 450 controls the drive circuit 430 to supply the working current I_work for the LED circuit 240 via the control signal Ctrl_Cur, so that the LED element emits strobe light with a high intensity (e.g. 40, 70 or 110 candelas). In the detection mode, the MCU 450 controls the drive circuit 430 to supply a detection current I_detect for the LED circuit 240 via the control signal Ctrl_Cur, so that the light energy emitted by the LED elements is far less than the alarming light energy (so that naked eyes can look at same directly) or even no light is emitted. At the same time, the MCU 450 collects V_LED sampled by the first sampling circuit 460 at the detection stage. Thus, according to the result observed from FIG. 3, i.e. when there is a small current flowing through the LED, the tube voltage drop on the LED approaches to Vd. Based on this, a determination unit in the MCU 450 may determine whether there is a fault in these LED elements based on the value of V_LED.

In some embodiments, criteria for the MCU 450 to determine whether there is a fault may include any of the following, alone or in combination:

- If the overall voltage drop V_LED substantially approaches to or is equal to the sum of threshold voltages Vd of all the LED elements in the LED circuit 240, i.e. V_LED≈N*Vd (wherein N is the number of LED elements), it is indicated that the LED circuit works normally.
- If the overall voltage drop V_LED approaches an output voltage Vmax of the energy storage circuit or is greater than the sum of threshold voltages Vd of all the LED elements in the LED circuit 240, it is indicated that an open-circuit fault occurs in at least one LED element in the LED circuit 240.
- If the overall voltage drop V_LED is less than the sum of threshold voltages Vd of all the LED elements in the LED circuit 240, i.e. V_LED<N*Vd (wherein N is the number of LED elements), it is indicated that a short-circuit fault occurs in at least one of the LED elements.

In some embodiments, it is generally considered that, when the voltage between the two ends of an LED element is lower than the threshold voltage thereof by a certain percent, short-circuit occurs in the LED element. For this, with regard to the short-circuit fault, the following formula may further be utilized for determination: if V_LED<(N−1)*Vd+α*Vd, where 0<α<1, α is an empirical value, then it is indicated that a short-circuit fault occurs in at least one of the LED elements, wherein α is preferably 50%.

The strobe notification appliance shown in FIG. 4 achieves fault detection of the LED elements by applying a small current to the LED elements connected in series. Such a strobe notification appliance cannot only have a self-detection function, but will also not enable the LED to emit light with an excessively high intensity at the detection stage.

Figure 5:
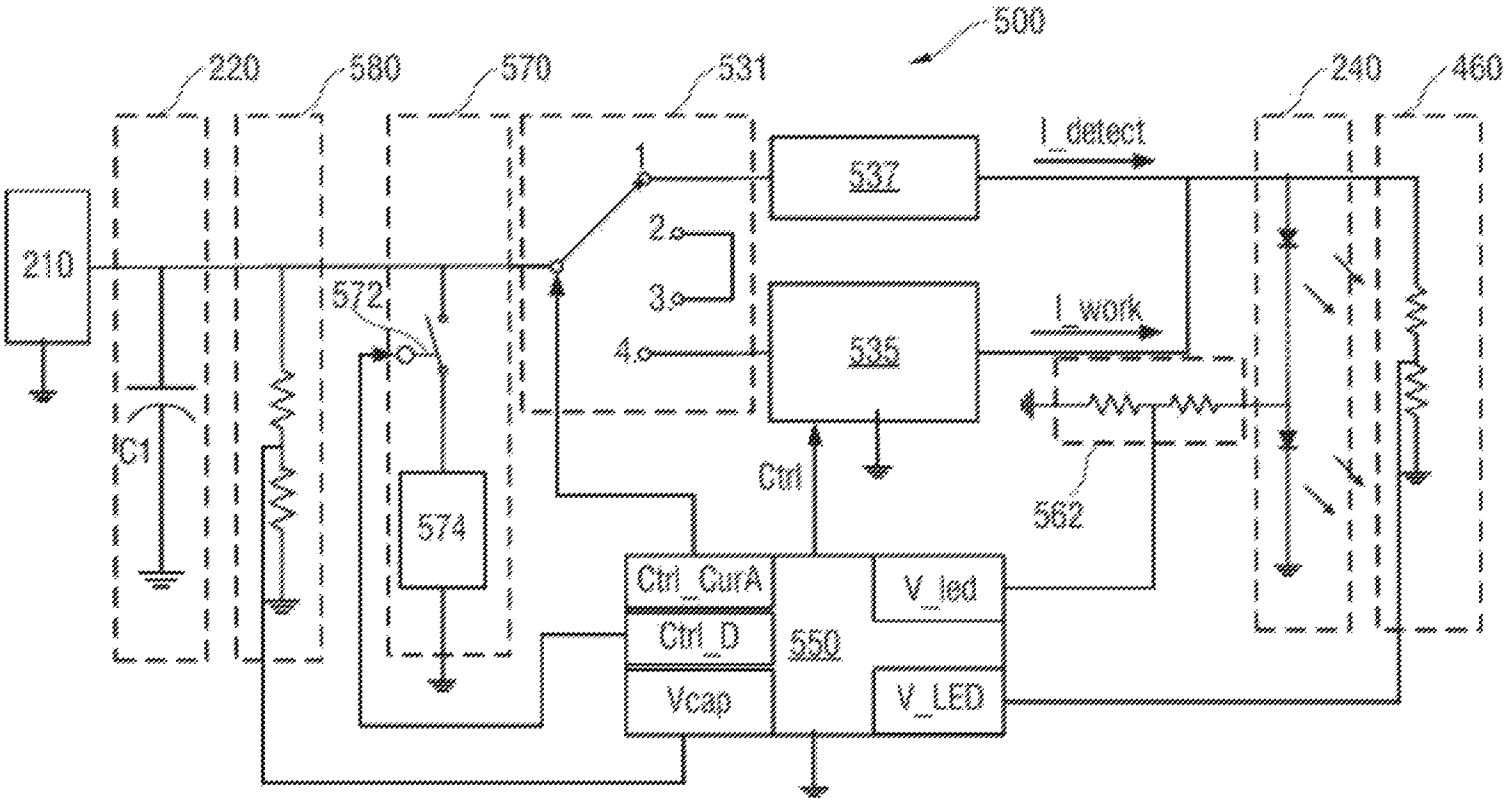
FIG. 5 shows a circuit of a strobe notification appliance according to teachings of the present disclosure.

FIG. 5 shows an example strobe notification appliance according to teachings of the present disclosure. Similar to FIG. 4, the strobe notification appliance 500 in FIG. 5 comprises a boost circuit 210, an energy storage circuit 220, and an LED circuit 240 comprising a plurality of LED elements connected in series. The elements have the same or similar function as or to those in FIG. 4, and this will not be described again herein. The drive circuit 530 in the strobe notification appliance 500 comprises a multi-throw switch 531, a working current generation circuit 535 and a detection current generation circuit 537, wherein the multi-throw switch 531 is controlled by a control signal Ctrl_CurA from the MCU 540. In some embodiments, the working current generation circuit 535 may output a working current at a fixed frequency. The detection current generation circuit 537 is a current-limiting resistor, or a constant current source to control the amplitude value of the output current.

In the example shown in FIG. 5, the current value of the detection current is set to enable all the LED elements to work in the transition zone T shown in FIG. 3, that is, there is a small current flowing through the LED but the LED elements do not emit light. Specifically, as shown in FIG. 5, the working current generation circuit 535 and the detection current generation circuit 537 are both connected to the LED circuit 240. Under the control of the multi-throw switch 531, the circuit 535 and the circuit 537 may respectively supply current for the LED circuit 240.

The multi-throw switch 531 acts in response to the control signal Ctrl_CurA from the MCU 550. The control signal Ctrl_CurA may have at least three states, namely, an alarming state (Alarm), a monitoring state (Mon), and an idle state (Idle). In the example in FIG. 5, the multi-throw switch 531 also has three groups of contact points accordingly. As shown in FIG. 5, the common end of the multi-throw switch 531 is connected to the output of the energy storage circuit 220. The contact point 1 is connected to the input of the detection current generation circuit 537. The contact point 2 and the contact point 3 are connected to each other and levitate without being connected to any other components. The contact point is connected to the input of the working current generation circuit 535.

The action process of the strobe notification appliance shown in FIG. 5 will be described below. Firstly, in an idle state, the MCU 550 sets the control signal Ctrl_CurA as in the idle state (Idle), so that a movable contact point of the multi-throw switch 531 is connected to a stationary contact point 2. At this moment, the boost circuit 210 charges a capacitor 220 into a peak value Vcap=Vmax1, e.g. Vmax1≈35 V, which is slightly greater than the sum of the forward tube voltage drop Vd of all the LED elements in the LED circuit 240, that is, Vmax>N*Vd, wherein N is the number of LED elements, and N≥1.

Thus, the MCU 550 sets the control signal Ctrl_CurA into a monitoring state (Mon), so that the movable contact point of the multi-throw switch 531 is connected to a stationary contact point 1. At this moment, the circuit 537 supplies the detection current I_detect for the LED circuit 240. In this embodiment, the magnitude of the detection current I_detect is chosen to enable the LED elements to work in the transition zone T shown in FIG. 3, that is, there is a current flowing through the LED elements but no light is emitted. If the circuit 537 is a current-limiting resistor R, then the detection current I_detect may be represented as:

$$I_detect=(V\max-V_LED)/R.$$

At the same time, the MCU 550 obtains the sampled overall voltage drop V_LED of the LED circuit from the first sampling circuit 460, and accordingly performs fault determination based on the criteria as stated previously. After the detection is completed, the MCU 550 sets the control signal Ctrl_CurA back into the idle state (Idle), so that the movable contact point of the multi-throw switch 531 is connected to the stationary contact point 2 and continues to charge the capacitor in the energy storage circuit 220.

When there is fire, the MCU 550 sets the control signal Ctrl_CurA into a monitoring state (Alarm), so that the movable contact point of the multi-throw switch 531 is connected to a stationary contact point 4. At this moment, the circuit 535 supplies the working current I_work for the LED circuit 240, so that the LED elements flash with a high intensity In the example shown in FIG. 5, the strobe notification appliance 500 further has a second sampling circuit 562, which samples a voltage V_led at a positive end of the last LED element (i.e. an LED element of which a negative end is connected to ground), and supplies the sampling value to the MCU 550. The MCU 550 may perform fault determination by combining the two sampling values from the sampling circuit 562 and the sampling circuit 460. Such criteria are shown exemplarily below:

Normal:

if $Vd*(1-d) \leq V_led \leq Vd*(1+d)$, and $(N-1)*Vd*(1-d)+\alpha*Vd \leq V_LED \leq N*Vd*(1+d)$ (wherein d is a tolerance value of the threshold voltage of the LED elements, and $\alpha$ is an empirical value, $0<\alpha<1$), then it is indicated that all the LED elements in the LED circuit 240 work normally.

Fault:

if $V_led<Vd*(1-d)$ or $V_led>Vd*(1+d)$, or $V_LED<(N-1)*Vd*(1-d)+\alpha*Vd$ or $V_LED>N*Vd*(1+d)$, then it is indicated that at least one LED element in the LED circuit 240 has a fault.

In the case where it is determined that there is a fault, the MCU 550 may further distinguish short-circuit from open-circuit.

Short-Circuit:

if $V_LED<(N-1)*Vd*(1-d)+\alpha*Vd$, wherein $0<\alpha<1$, a is an empirical value, e.g. $\alpha=50\%$, then it is indicated that at least one LED element in the LED circuit 240 has a short-circuit fault.

Or if $V_led<Vd*(1-d)$ and $V_LED<(N-1)*Vd*(1-d)+\alpha*Vd$, then it is indicated that a short-circuit fault occurs in the LED elements in the LED circuit 240, and at least the last LED elements has a short-circuit fault.

Open-Circuit:

if $V_LED>1V*Vd*(1+d)$, then it is indicated that an open-circuit fault occurs in the LED elements in the LED circuit 240.

If $V_led>Vd*(1+d)$, then it is indicated that only the last LED element in the LED circuit 240 has an open-circuit fault.

The tolerance value of Vd may be taken into consideration in the criteria above. In an environment which does not require a high precision, the tolerance may also be omitted. Therefore, the sampling value of the second sampling circuit 562 may be in mutual cooperation with the sampling value of the first sampling circuit 560 for fault determination, and the existence of the second sampling circuit 562 may improve the accuracy of fault determination, avoid false alarm, and may further determine the fault position of the LED elements.

In some embodiments, such as in the example shown in FIG. 5, in addition to fault detection for the LED elements, the strobe notification appliance 500 may also be able to detect the degeneration conditions of the capacitor C1 in the energy storage circuit 220. As shown in FIG. 5, the strobe notification appliance 500 in FIG. 5 further comprises a third sampling circuit 580 and a discharging circuit 570. The third sampling circuit 580 collects the voltage value Vcap between the two ends of the capacitor C1. The discharging circuit 570 comprises a controlled switch 572 and a current-limiting circuit 574. The current-limiting circuit 574 may be a current-limiting resistor of a constant current source, and the objective thereof is to control the magnitude of the discharging current when the capacitor discharges. The controlled switch 572 is controlled by a Ctrl_D end of the MCU 550. When Ctrl_CurA is in an idle state (Idle) and the capacitor C1 is fully charged (for example, Vcap reaches a higher value, Vcap=Vmax2, e.g. Vmax2≈40~50 V), if it is expected to detect the conditions of the capacitor, then the MCU 550 may set Ctrl_D as effective, i.e. the controlled switch 572 is closed, and the capacitor C1 discharges via the current-limiting circuit 574. The MCU 550 collects the voltage value Vcap from a third sampling circuit.

With regard to the case where the current-limiting circuit 574 is a current-limiting resistor r, the actual capacitance C of the capacitor C1 may be represented by the following formula:

$$C = \frac{t}{r \cdot \ln\left(\frac{V_0}{Vt}\right)}$$

where t denotes discharging time;

r denotes the resistance of the current-limiting resistor;

$V_0$ denotes an initial voltage of the capacitor prior to discharging; and $V_t$ denotes the residual voltage of the capacitor after the discharging time t.

With regard to the case where the current-limiting circuit 574 is a constant current source I, considering that the time and current used in each detection process of the LED elements substantially keeps unchanged, the actual capacitance C of the capacitor C1 may be represented by the following formula:

$$C = C_0 * \frac{\Delta U_0}{\Delta U_t}$$

where C0 is the capacitance of the capacitor C1 when leaving the factory;

$\Delta U_0$ is the difference between the voltages Vcap on the capacitor C1 before and after the first detection for the LED elements; $C_0$ and $\Delta U_0$ may be stored in a memory of the MCU in advance; and $\Delta U_t$ is the difference between the voltages Vcap on the capacitor C1 before and after the current (after a period of time of use) detection for the LED elements.

Applying the third sampling circuit 580 and a discharging circuit 570 above, and utilizing the capacitor capacitance calculation formula can detect and calculate the actual capacitance of the capacitor C1. The actual capacitance may be used to calculate the energy storage efficiency of the strobe notification appliance, and to complement the degeneration of the capacitor C1.

Optionally, if the current-limiting circuit 574 is a constant current source I, and the constant current source I is relatively stable and the current value thereof may be deemed as a constant value, then the actual capacitance C of the capacitor C1 may be calculated by utilizing the following formula:

$$C = \frac{I * t}{\Delta U_t}$$

where $\Delta U_t$ is the difference between the voltages Vcap on the capacitor C1 before and after the current (after a period of time of use) detection phase for the LED elements;

I is the magnitude of the current of a known constant current source; and t is the discharging time of the capacitor.

Applying a stable constant current source and utilizing the above formula to determine the actual capacitance of the capacitor C1 may omit the storage of the initial value of the capacitor, and is more convenient for calculation.

Figure 6:
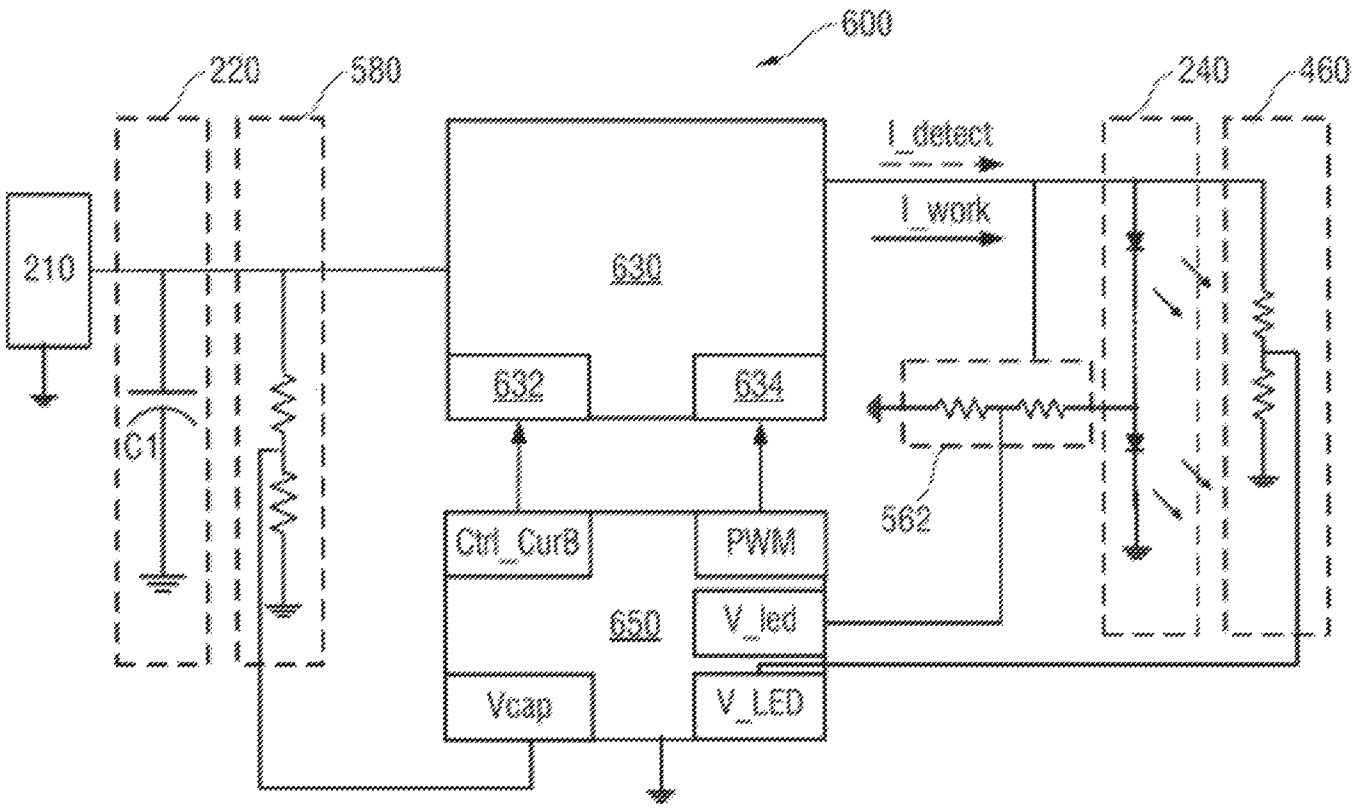
FIG. 6 shows a circuit of a strobe notification appliance according to teachings of the present disclosure.

FIG. 6 shows an example strobe notification appliance according to one more embodiment of the present invention. Similar to FIGS. 4 and 5, the strobe notification appliance 600 in FIG. 6 comprises a boost circuit 210, an energy storage circuit (a capacitor C1) 220, an LED circuit 240 comprising a plurality of LED elements connected in series, and a first sampling circuit 460 and a second sampling circuit 562. The elements have the same or similar function as or to those in the previous figures, and this will not be described again herein. Being different from FIGS. 4 and 5, the drive circuit 630 in the strobe notification appliance 600 comprises a current regulating end 632 and an enable end 634. These two input ends are respectively controlled by a control end Ctrl_CurB (e.g. an analogue signal) of the MCU 650 and a PWM (e.g. a pulse width modulation signal). The internal structure of the drive circuit 630 may be substantially the same as that of the existing drive circuit (i.e. an LED drive chip), and the difference lies in that it can change the amplitude value of an output current thereof in response to an input from the current regulating end 632, and achieve chopping on the output current in response to an input from the enable end 634, thereby changing the frequency and duty cycle of a pulse output current.

In the example shown in FIG. 6, the magnitude of the detection current may be set to enable the light-emitting intensity of the LED elements to be relatively weak, and can be directly looked at using naked eyes in the maximum light intensity. At the same time, the detection current is a pulse mode, and the drive LED elements are illuminated intermittently. Optionally, the duty cycle of the pulse detection current may be fixed, and may also periodically change within a pre-determined period.

Figure 7:
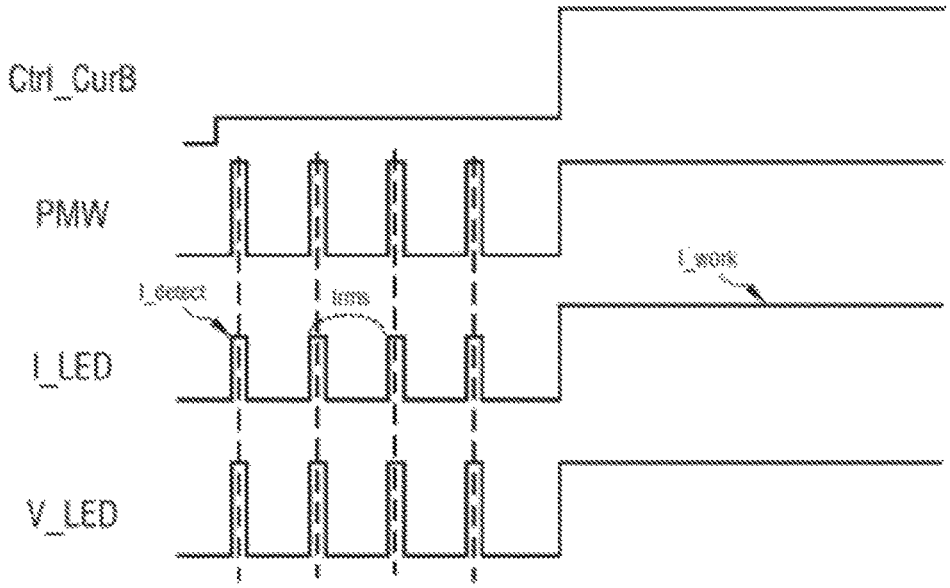
FIG. 7 shows a diagram of waveforms of various signals which use the circuit shown in FIG. 6 and utilize a detection current with a fixed duty cycle.

FIG. 7 shows example signal waveforms of a detection phase and an alarming phase according to teachings of the present disclosure. In the alarming phase, Ctrl_CurB=V1, the PWM is a working frequency and duty cycle required when alarming. At this time, the drive circuit 630 outputs a working current I_work to the LED circuit 240. In the detection phase, Ctrl_CurB=V2, V2<V1, and the PWM is a pulse signal with a constant duty cycle (e.g. D=15%). In response to Ctrl_CurB and PWM, the drive circuit 630 outputs a detection current I_detect to the LED circuit 240. The waveform of the detection current is as shown in FIG. 7. The amplitude value of the detection current is I_detect, and in this detection current, the light-emitting intensity of the LED elements is proportional to the effective value (or referred to as root-mean-square) of the detection current, Irms=I_detect*D, wherein I_work≥I_detect>Irms. Irms is far less than the effective value of I_work. The MCU 650 acquires a voltage value V_LED/V_led from the first sampling circuit 460 and/or the second sampling circuit 562 at the center point of each detection current pulse, and V_LED should be substantially consistent with the waveform of the detection current in the case of no fault. Thus, the MCU 650 performs fault determination according to the previous criteria.

Applying pulse detection light shown in FIG. 7, even if the amplitude value of a single detection current pulse approaches to or is equal to the working current, since the pulse width thereof can be controlled as very small, for example, a millisecond magnitude, the overall illumination formed thereby may also not damage human eyes. In addition, using such a pulse detection current to drive the LED elements may further reduce the electric energy consumption at the detection stage, and is less likely to draw excessive attention from field staff.

Figure 8:
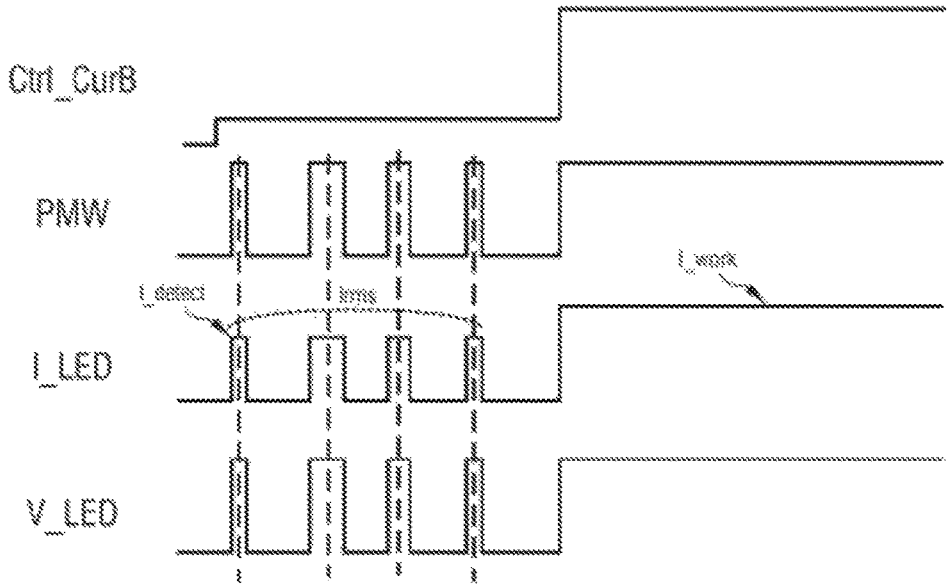
FIG. 8 shows a diagram of waveforms of various signals which use the circuit shown in FIG. 6 and utilize a breath-type detection current.

FIG. 8 shows example signal waveforms of a detection phase and an alarming phase according to teachings of the present disclosure. Similar to FIG. 7, in the alarming phase, Ctrl_CurB=V1, the PWM is a working frequency and duty cycle required when alarming. At this time, the drive circuit 630 outputs a working current I_work to the LED circuit 240, so that the LED elements emit corresponding high-power alarming light. In the detection phase, Ctrl_CurB=V2, and V2<V1. In the example of FIG. 8, the PWM is a pulse signal with a periodically changing duty cycle (D), for example, the change of the duty cycle is to circulate once every four pulses, and the duty cycle gradually changes within the four pulses (e.g. 15%, 50%, 30% and 15%). In response to Ctrl_CurB and PWM, the drive circuit 630 outputs a detection current I_detect to the LED circuit 240. The waveform of the detection current I_detect is as shown in FIG. 8. The amplitude value of the detection current is that I_detect≤I_work, and the waveform is a pulse signal with a periodically changing pulse width, which is substantially consistant with a PWM signal. In this detection current, the LED element forms a breath-type light-emitting mode. The light-emitting intensity of the LED elements may be proportional to the mean square value Irms of the detection current:

$$I_{RMS} = \text{I_detect} * \frac{\sum_{i=1}^{M} D_i}{M}$$

where M is the number of pulses within one breath period, for example, M=3;

i is an index of different duty cycle values; and

Di is different duty cycle values.

The MCU 650 acquires a voltage value V_LED/V_led from the first sampling circuit 460 and/or the second sampling circuit 562 at the center point of each detection current pulse, and the voltage value may be substantially consistent with the waveform of the detection current in the case of no fault. Thus, the MCU 650 performs fault determination according to the previous criteria (FIGS. 4 and 5).

Applying the breath-type detection light shown in FIG. 8, the light emitted by the LED elements is softer and provides a comfortable feeling for field staff, and may even not damage naked eyes. At the same time, since a pulse width regulation method is used, the electric energy consumption at the detection stage may further be decreased.

Although the pulse width regulation method is applied in both FIGS. 7 and 8, in practical applications, a weak current may also be used to drive the LED elements and to enable the LED elements to keep illuminated for a period of time for detection. At this time, the LED elements only emit weak light and may not damage naked eyes.

In addition, as shown in FIG. 6, the strobe notification appliance 600 further has a third sampling circuit 580 for detecting capacitor degeneration conditions. Similar to FIG. 5, considering that the time and current used in each detection process substantially keeps unchanged, the actual capacitance C of the capacitor may be represented by the following formula:

$$C = C_0 * \frac{\Delta U_0}{\Delta U_t}$$

where $C_0$ is the capacitance when leaving the factory;

$\Delta U_0$ is the difference between the voltages Vcap on the capacitor C1 before and after the first detection for the LED elements; $C_0$ and $\Delta U_0$ may be stored in a memory of the MCU in advance; and $\Delta U_t$ is the difference between the voltages Vcap on the capacitor C1 before and after the current (after a period of time of use) detection for the LED elements.

Optionally, considering that the electric energy consumed in each detection phase is substantially consistent, for this, the actual capacitor capacitance may be determined according to a relationship between the energy consumed in each detection phase and capacitor discharging. In some embodiments, the following formula may be utilized to calculate the actual capacitance C of the capacitor C1:

$$C = \frac{I * t}{\Delta U_t}$$

where $\Delta U_t$ is the difference between the voltages Vcap on the capacitor C1 before and after the current (after a period of time of use) detection phase;

I is an effective value Irms of the discharging current (that is, the detection current) in the previous detection phase; and t is the discharging time of the capacitor.

Applying a stable constant current source and utilizing the above formula to determine the actual capacitance of the capacitor C1 may omit the storage of the initial value of the capacitor, and is more convenient for calculation.

Applying the third sampling circuit 580 above, and utilizing the capacitor capacitance calculation formula can detect and calculate the actual capacitance of the capacitor. The actual capacitance may be used to calculate the energy storage efficiency, and to complement the decay of the capacitor. Moreover, in the example shown in FIG. 6, the detection for the energy storage circuit may be implemented without the discharging circuit. Thus, the detection for the LED elements and the detection for the energy storage circuit may be completed simultaneously.

It should be understood that although the present teachings are described according to various embodiments, each embodiment does not only contain one independent technical solution, and such narrative style of the description is merely for being clear, and those of skill in the art should take the description as a whole and the technical solutions in the various embodiments may also be combined appropriately to form other implementations which can be understood by those of skills in the art. A series of detailed descriptions listed above are merely specific description regarding feasible embodiments of the present disclosure and they do not limit the scope of protection. Any equivalent implementation solutions or variations, such as a combination, division, or repetition of features made without departing from the technical spirit of the present disclosure should all be contained within the scope of protection.

What is claimed is:

1. A strobe notification appliance comprising:

a boost circuit connected to an input voltage of the strobe notification appliance to supply electric energy;

an energy storage circuit charged by the boost circuit;

a drive circuit powered by the energy storage circuit to generate a drive current;

an LED circuit with a plurality of LED elements connected in a series configuration supplying the drive current to the LED elements;

a first sampling circuit collecting an overall voltage drop of the plurality of LED elements in the LED circuit;

a control circuit connected to the drive circuit and configured to adjust the drive circuit to supply a working current during an alarming stage and supply a detection current during a detection stage; and a discharging circuit connected to two ends of the energy storage circuit in parallel, the discharging circuit comprising a current-limiting circuit and a controlled switch connected in series to the current-limiting circuit;

wherein the detection current is lower than the working current and thereby light energy produced by the LED elements during the detection stage is lower than alarming light energy produced during the alarming stage;

wherein the control circuit controls the controlled switch to switch on at the detection stage, and thereby to cause the energy stored in the energy storage circuit to be discharged via the current-limiting circuit;

wherein the control circuit further, during the detection stage, determines whether the LED circuit works normally based on the collected overall voltage drop.

2. The strobe notification appliance of claim 1, wherein the detection current is between 100 μA to tens of mA.

3. The strobe notification appliance of claim 1, wherein the detection current is a constant current or the detection current is in a pulse form.

4. The strobe notification appliance of claim 1, wherein the control circuit makes the determination according to the following criterion: if the overall voltage drop is substantially equal to the sum of threshold voltages of the plurality of LED elements, the LED circuit works normally.

5. The strobe notification appliance of claim 4, further comprising a second sampling circuit collecting a first voltage at a positive end of a first LED element;

wherein a negative end of the first LED element is connected to the ground; and the control circuit makes the determination according to the following criterion: if the overall voltage drop is substantially equal to the sum of threshold voltages of all the LED elements and the first voltage is substantially equal to a positive threshold voltage of the first LED element, the LED circuit works normally.

6. The strobe notification appliance of claim 1, wherein the control circuit makes the determination according to the following criterion: if the overall voltage drop is greater than the sum of threshold voltages of all the LED elements in the LED circuit (240), an open-circuit fault is present in at least one of the LED elements.

7. The strobe notification appliance of claim 1, wherein the control circuit makes the determination according to the following criterion: if the overall voltage drop is less than the sum of threshold voltages of all the LED elements in the LED circuit, a short-circuit fault is present in at least one of the LED elements.

8. The strobe notification appliance of claim 1, wherein the control circuit determines that at least one LED element in the LED circuit is short-circuited if the overall voltage drop meets the following condition:

$$V_LED<(N-1)*Vd+\alpha*Vd,$$

where

V_LED is the overall voltage;

Vd is the threshold voltage of each LED element;

N is the number of the LED elements in the LED circuit (240);

$\alpha$ is an empirical value, $0<\alpha<1$, preferably, $\alpha$ is substantially equal to 50%.

9. The strobe notification appliance of claim 1, wherein the drive circuit comprises a current regulating end connected to the control circuit and selectively supplying one of the working current and the detection current for the LED circuit in response to a first instruction of the control circuit.

10. The strobe notification appliance of claim 9, wherein the drive circuit further comprises an enable end connected to the control circuit and selectively turning on or turning off the current output of the drive circuit in response to a second instruction of the control circuit, wherein the second instruction is a pulse width modulation signal.

11. The strobe notification appliance of claim 1, wherein the current-limiting circuit comprises a current-limiting resistor, and the control circuit calculates the actual capacitance of the capacitor according to the following formula:

$$C=\frac{t}{r\cdot\ln\left(\frac{V_0}{V_t}\right)}$$

where t denotes discharging time;

r denotes the resistance of the current-limiting resistor;

$V_0$ denotes an initial voltage of the capacitor prior to discharging; and $V_t$ denotes the residual voltage of the capacitor after the discharging time t.

12. The strobe notification appliance of claim 1, wherein the ratio of an effective value of the working current to an effective value of the detection current is greater than 60 times.

13. The strobe notification appliance of claim 1, wherein the ratio of the effective value of the working current to the effective value of the detection current is greater than 100 times.

14. The strobe notification appliance of claim 1, wherein the detection current has a pulse shape with a periodic change in a duty cycle.

15. A strobe notification appliance comprising:

a boost circuit connected to an input voltage of the strobe notification appliance to supply electric energy;

an energy storage circuit charged by the boost circuit;

a drive circuit powered by the energy storage circuit to generate a drive current;

an LED circuit with a plurality of LED elements connected in a series configuration supplying the drive current to the LED elements;

a first sampling circuit collecting an overall voltage drop of the plurality of LED elements in the LED circuit;

a control circuit connected to the drive circuit and configured to adjust the drive circuit to supply a working current during an alarming stage and supply a detection current during a detection stage; and a second sampling circuit collecting energy storage voltages on two ends of a capacitor in the energy storage circuit;

wherein the detection current is lower than the working current and thereby light energy produced by the LED elements during the detection stage is lower than alarming light energy produced during the alarming stage;

wherein the control circuit further, during the detection stage, determines whether the LED circuit works normally based on the collected overall voltage drop; and wherein the control circuit determines an actual eigenvalue of the capacitor according to the energy storage voltages sampled by the second sampling circuit and a sampling time interval.

16. The strobe notification appliance of claim 15, wherein the control circuit calculates the actual capacitance of the capacitor according to the following formula:

$$C=\frac{I*t}{\Delta U_t}$$

where $\Delta U_t$ is the difference between the voltages on the capacitor before and after the current detection stage, I is an equivalent current value when the capacitor is discharged, and t is the discharging time of the capacitor.

17. The strobe notification appliance of claim 15, wherein the control circuit calculates the actual capacitance of the capacitor according to the following formula:

$$C=C_0*\frac{\Delta U_0}{\Delta U_t}$$

where $C_0$ is the capacitance of the capacitor when leaving the factory;

$\Delta U_0$ is the difference between the voltages on the capacitor before and after the first detection stage; and $\Delta U_t$ is the difference between the voltages on the capacitor before and after the current detection stage.

18. A strobe notification appliance comprising:

a boost circuit connected to an input voltage of the strobe notification appliance to supply electric energy;

an energy storage circuit charged by the boost circuit;

a drive circuit powered by the energy storage circuit to generate a drive current;

an LED circuit with a plurality of LED elements connected in a series configuration supplying the drive current to the LED elements;

a first sampling circuit collecting an overall voltage drop of the plurality of LED elements in the LED circuit; and a control circuit connected to the drive circuit and configured to adjust the drive circuit to supply a working current during an alarming stage and supply a detection current during a detection stage;

wherein the drive circuit comprises:

a working current generation circuit supplying the working current for the LED circuit to emit alarming light;

a detection current generation circuit supplying the detection current for the LED circuit; and a toggle switch selectively transferring the electric energy from the energy storage circuit to one of the working current generation circuit and the detection current generation circuit;

wherein the control circuit is connected to the toggle switch and the toggle switch switches in response to a signal from the control circuit;

wherein the detection current is lower than the working current and thereby light energy produced by the LED elements during the detection stage is lower than alarming light energy produced during the alarming stage; and wherein the control circuit further, during the detection stage, determines whether the LED circuit works normally based on the collected overall voltage drop.

* * * * *